US005433276A

United States Patent [19]

Martain et al.

[11] Patent Number: 5,433,276

[45] Date of Patent: Jul. 18, 1995

[54] METHOD AND SYSTEM FOR INSERTING LOGGING TOOLS INTO HIGHLY INCLINED OR HORIZONTAL BOREHOLES

[75] Inventors: Randall H. Martain, Friendswood; Patrick M. Mulcahy, Missouri City, both of Tex.

[73] Assignee: Western Atlas International, Inc., Houston, Tex.

[21] Appl. No.: 323,749

[22] Filed: Oct. 17, 1994

[51] Int. Cl.[6] ..... E21B 23/00; E21B 47/00

[52] U.S. Cl. ..... 166/384; 166/65.1; 166/385; 166/50

[58] Field of Search ..... 166/384, 385, 77, 240, 166/250, 65.1, 50

[56] References Cited

U.S. PATENT DOCUMENTS

| | | | |
|---|---|---|---|
| 3,401,749 | 9/1968 | Daniel | 166/384 |
| 4,457,370 | 7/1984 | Wittrisch | 166/250 |
| 5,305,830 | 4/1994 | Wittrisch | 166/384 X |
| 5,392,851 | 2/1995 | Arend | 166/384 X |

OTHER PUBLICATIONS

Brochure "Wireline Conveyance Systems (WCS)", Western Atlas International, Inc. (printed in 1989).

*Primary Examiner*—Stephen J. Novosad
*Attorney, Agent, or Firm*—Richard A. Fagin

[57] ABSTRACT

The present invention is a method and apparatus for inserting electric wireline tools into a wellbore using an apparatus comprising pipe assembled from sections and coiled tubing having a coaxially inserted wireline. The method includes the steps of attaching a first part of a submersible electrical connector to one end of the coiled tubing and to the wireline inside the coiled tubing. A second part of the submersible connector is attached to one end of the wireline tools. A first part of a selectively operable latching mechanism is attached to the same end of the wireline tools. A second part of the latching mechanism forms part of a latching sub which is attached to one end of the pipe. The tools are attached to the pipe by engaging the first and second parts of the latching mechanism, and the tools are inserted into the wellbore to a predetermined depth by assembling the sections of the pipe. The coiled tubing is then inserted into the interior of the pipe until the submersible connector is engaged. The latching mechanism is selectively operated to release the tools from the sub, and the coiled tubing is inserted further into the wellbore until the tools reach a desired depth. The coiled tubing is then withdrawn until the tools engage the sub. The latching mechanism is then selectively operated so that the tools are attached to the sub. The coiled tubing is then withdrawn from the pipe, which disengages the submersible connector. The tools are then withdrawn from the wellbore by disassembling the sections of the pipe.

10 Claims, 6 Drawing Sheets

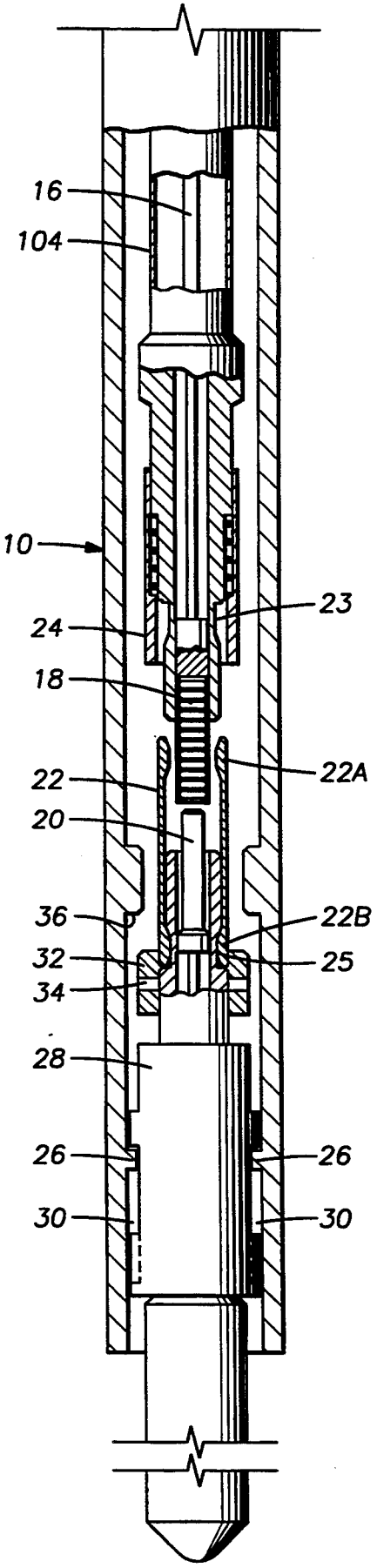
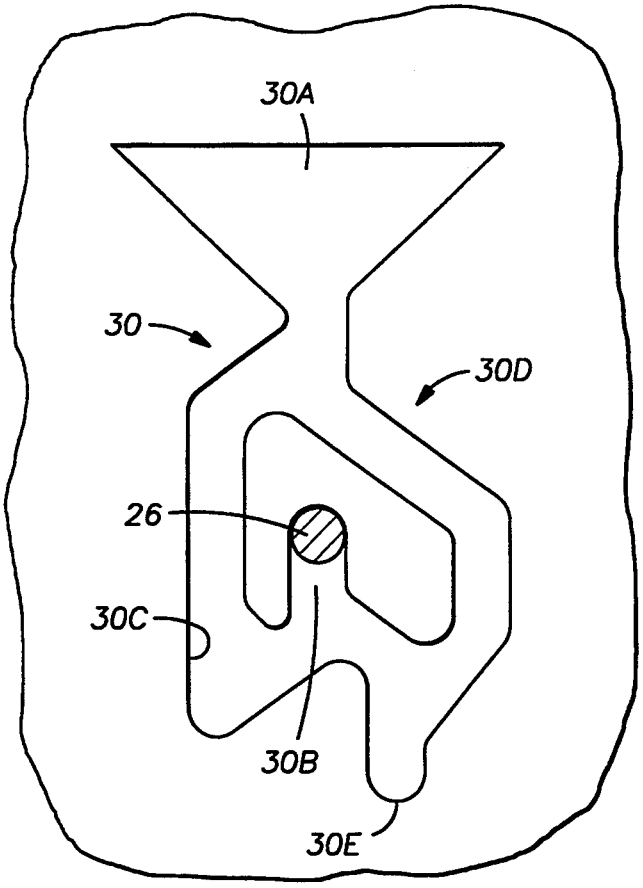
FIG. 2A
FIG. 2

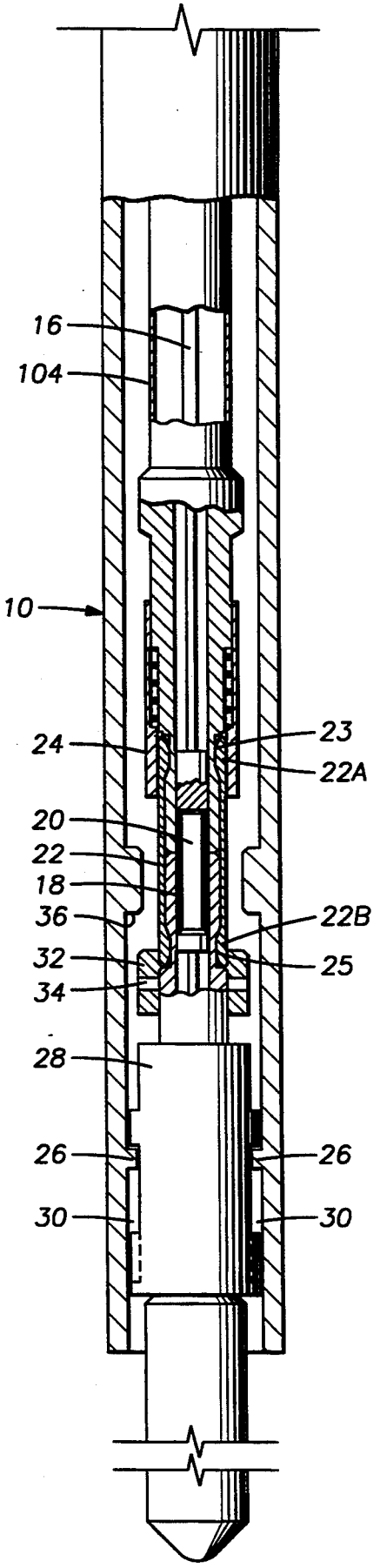
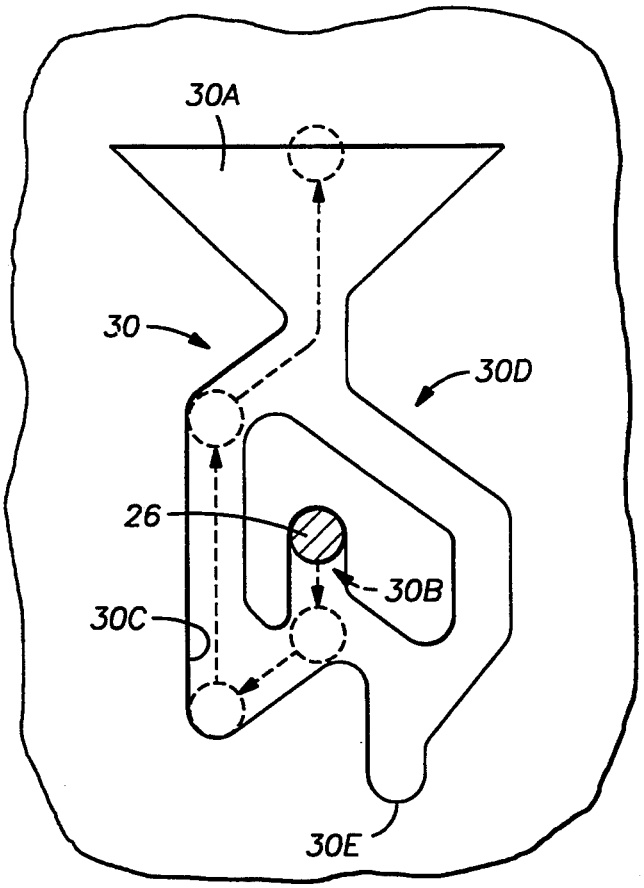
FIG. 3A
FIG. 3

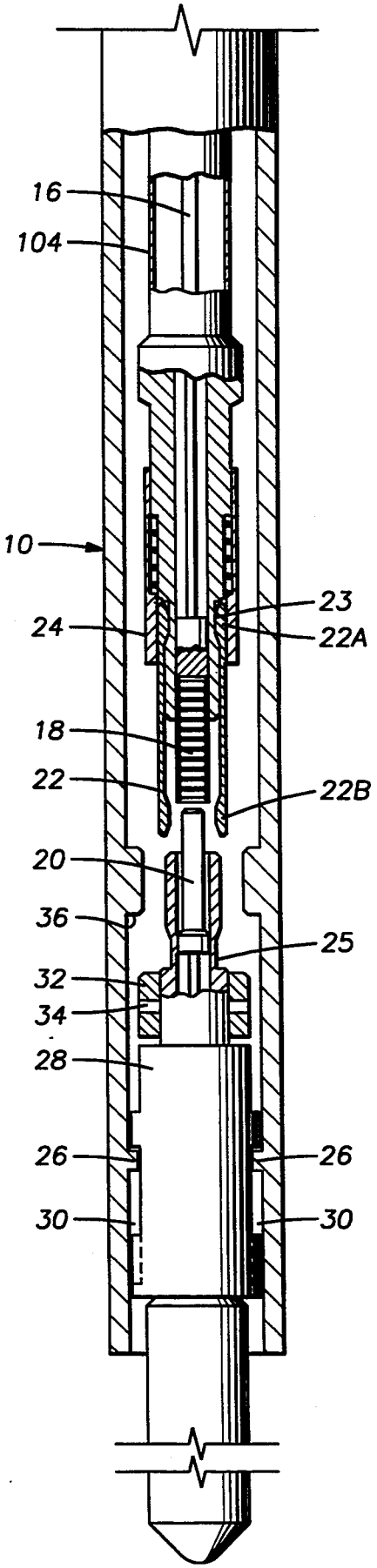
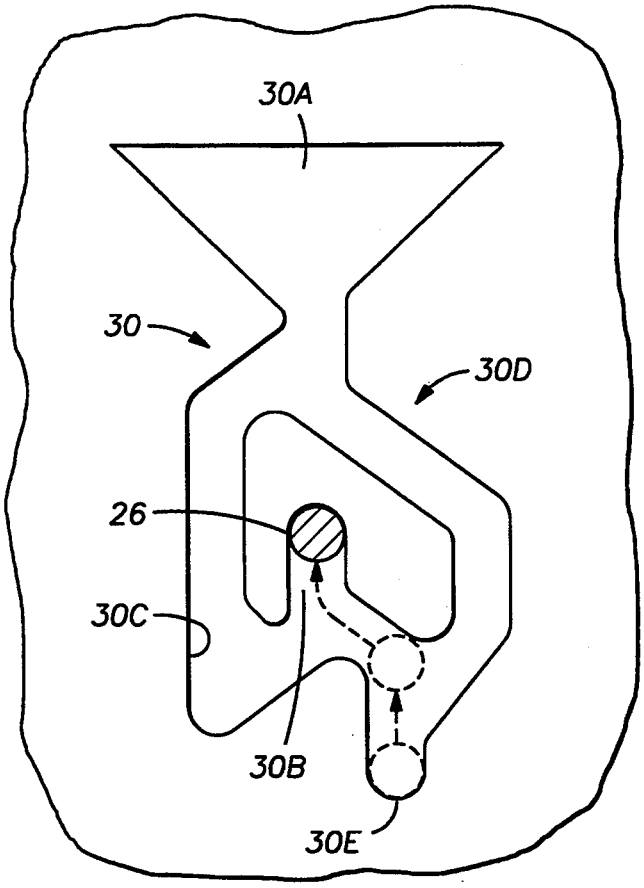
FIG. 6A
FIG. 6

METHOD AND SYSTEM FOR INSERTING LOGGING TOOLS INTO HIGHLY INCLINED OR HORIZONTAL BOREHOLES

BACKGROUND OF THE INVENTION

1. Field of the Invention

The present invention is related to the field of electric wireline wellbore logging tools. More specifically, the present invention is related to a system for inserting electric wireline tools into a highly inclined wellbore using both pipe and coiled tubing.

2. Discussion of the Related Art

Electric wireline wellbore logging tools are used for, among other things, making measurements of various physical properties of earth formations penetrated by wellbores. Electric wireline tools are typically inserted into the wellbore by the force of gravity, and are returned to the earth's surface by means of an armored electrical cable attached to the tool. The cable is drawn by a winch or similar spooling apparatus.

Certain wellbores are drilled so as to have very large inclination from vertical over at least a portion of the wellbore. Other wellbores can have a section which is substantially horizontal. Gravity cannot be used to insert logging tools into a highly inclined or horizontal portion of a wellbore, so various methods have been devised to insert logging tools into such highly inclined wellbores. For example, "Wireline Conveyance Systems", Atlas Wireline Services, Houston, Tex., 1991, describes several methods of inserting logging tools into highly inclined or horizontal wellbores.

One of the methods known in the art for inserting logging tools into highly inclined or horizontal wellbores is to attach the tools to the end of a pipe comprising threaded sections, and to lower the pipe into the wellbore by attaching additional sections to the pipe. After the tools are inserted to a desired depth in the wellbore, the electrical cable is attached to the tools by pumping the cable through the center of the pipe until the cable latches on to a special connector disposed at the top of the tools. The cable is inserted into the center of the pipe from the outside of the pipe through a device called a "side entry sub". A side entry sub is a short section of pipe having a sealable opening through a side wall of the section of pipe which enables passage of the cable through the wall of the sub. The side entry sub is typically assembled to the pipe at a substantial distance below the upper end of the pipe. Assembled in this position, the side entry sub enables raising the logging tools within the wellbore by removing sections from the pipe simultaneously with spooling of the cable as the tools are raised in the wellbore. In this way, portions of the wellbore can be measured with the logging tools without repeated insertion and removal of the cable from the inside of the pipe.

A drawback to using pipe to convey the logging tools is the presence of the cable outside the pipe from the position of the side entry sub up to the earth's surface. In some cases control of fluids which may be present in the wellbore requires using equipment located at the earth's surface designed to seal an annular space between the pipe and the wellbore. In other cases it is necessary to maintain fluid pressure on the wellbore from the earth's surface in order to obtain valid measurements from the tools in the wellbore. Cable disposed outside the pipe disturbs the operation of the sealing equipment and makes it difficult to seal the wellbore for maintaining fluid pressure.

Tools can also be inserted into the wellbore by using a coiled tubing having a coaxially inserted electrical cable. Because the cable is coaxially inserted through the coiled tubing, it is possible to seal the annular space between the wellbore and the coiled tubing with equipment similar to that used to seal the annular space outside the sectioned pipe.

One of the difficulties with coiled tubing used in highly inclined or horizontal wellbores, is that frictional force which develops between the wellbore wall and the coiled tubing as a result of the tubing contacting the lower wall of the wellbore can sometimes exceed the buckling strength of the coiled tubing. When the buckling strength of the tubing is exceeded, the tubing can kink or bend so that it becomes impossible to push the tools further into the wellbore.

It is an object of the present invention to provide a system for inserting logging tools into a highly deviated or horizontal wellbore using threaded pipe in which the annular space between the pipe and the wellbore can be sealed.

It is a further object of the present invention to provide a system for inserting logging tools in a highly deviated or horizontal wellbore which is resistant to failure caused by frictionally induced buckling of coiled tubing.

SUMMARY OF THE INVENTION

The present invention is a method and apparatus for inserting electric wireline tools into a wellbore using an apparatus comprising pipe assembled from sections and coiled tubing having a coaxially inserted wireline. The method includes the steps of attaching a first part of a submersible electrical connector to one end of the coiled tubing and to the wireline inside the coiled tubing. A second pan of the submersible connector is attached to one end of the wireline tools. A first part of a selectively operable latching mechanism is attached to the same end of the wireline tools. A second part of the latching mechanism forms part of a latching sub which is attached to one end of the pipe. The tools are attached to the pipe by engaging the first and second parts of the latching mechanism, and the tools are inserted into the wellbore to a predetermined depth by assembling the sections of the pipe. The coiled tubing is then inserted into the interior of the pipe until the submersible connector is engaged. The latching mechanism is selectively operated to release the tools from the sub, and the coiled tubing is inserted further into the wellbore until the tools reach a desired depth. The coiled tubing is then withdrawn until the tools engage the sub. The latching mechanism is then selectively operated so that the tools are attached to the sub. The coiled tubing is then withdrawn, which disengages the submersible connector. The tools are then withdrawn from the wellbore by disassembling the sections of the pipe.

BRIEF DESCRIPTION OF THE DRAWINGS

FIG. 2 shows the latching sub, the submersible connector, and the selectively operable latching mechanism of the present invention just prior to engagement of the connector, FIG. 2A shows a plan view of J-slots in the latching mechanism.

FIG. 3 shows the operation of the latching mechanism after engagement of the connector. FIG. 3A shows the operation of the pins relative to the J-slots.

FIG. 6 shows the coiled tubing being withdrawn from the pipe. FIG. 6A shows the operation of the pins relative to the J-slots.

DESCRIPTION OF THE PREFERRED EMBODIMENT

Figure 1:
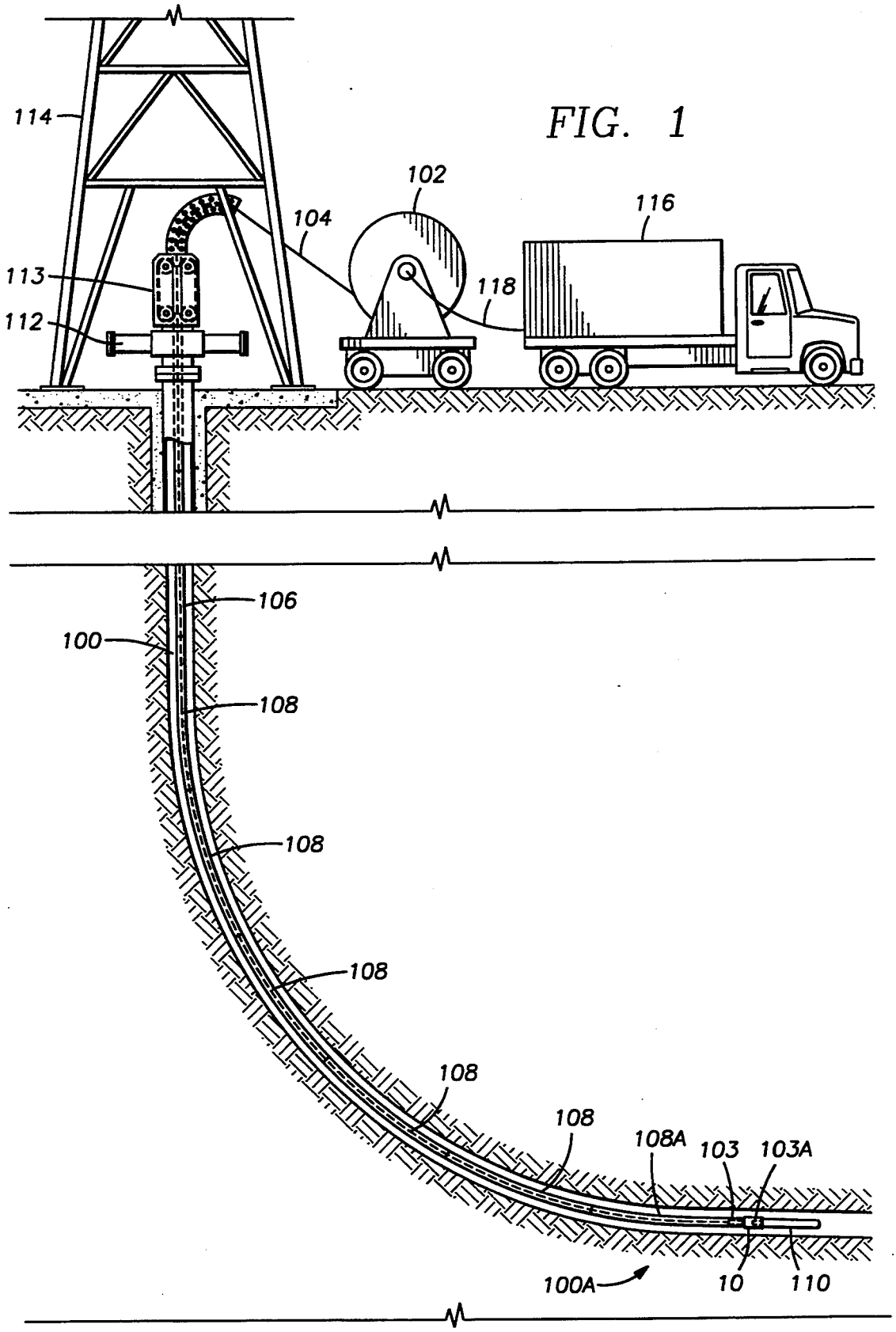
FIG. 1 shows wireline tools being lowered into a wellbore and a coiled tubing being lowered inside a pipe according to the present invention.

The operation of the present invention can be better understood by referring to FIG. 1. Wireline tools 110 are lowered into a wellbore 100 by means of a pipe 106, which can be drillpipe or tubing, assembled from threadedly connected sections 108. The pipe 106 is lengthened by adding sections 108. The sections 108 are added or removed by a drilling rig 114 or similar apparatus.

The tools 110 are attached to a lowermost section 108A of the pipe 106 by a latching sub 10, which will be explained further. During insertion of the tools 110 into the wellbore 100, sections 108 are added to the pipe 106 until the tools 110 are positioned at a predetermined depth in the wellbore 100 chosen by the operator. The predetermined depth is typically within a highly inclined portion 100A of the wellbore 100.

A coiled tubing 104 comprising a coaxially inserted wireline (shown at its upper terminal end as 118) can be reversibly inserted inside the pipe 106 by reeling from a spooling unit 102, and a tractor/guide roller assembly 113. The wireline 118 is ultimately connected to a surface logging unit 116 which provides power to the tools 110. Signals from the tools 110 can be sent to the surface unit 116 via the wireline 118.

If it were to prove necessary to contain fluid inside the wellbore 100, or to apply pressure to the wellbore 100, an annular space between the wellbore 100 and the pipe 106 can be sealed by means of annular sealing equipment 112 attached to the top of the wellbore 100.

The coiled tubing 104 is inserted into the pipe 106 until a first component 103 of a submersible electrical connector contacts a second component 103A of the connector which is attached to the upper end of the tools 110. The submersible connector can be of a type adapted to make mechanical and electrical connections to electric wireline tools while the connector is submerged in liquid. A typical submersible connector is described, for example, in U.S. Pat. No. 4,457,370 issued to Wittrisch. The connector disclosed in the Wittrisch patent is sold under the trade name Simphor.

After the first and second components 103, 103A of the connector are engaged, a selectively operable latching mechanism, one part of which is attached to the sub 10 and another part of which is attached to the upper end of the tools 110, is disengaged to enable the tools 110 to be pushed out of the end of the pipe 106 to a desired depth in the inclined portion 100A of the wellbore 100 by further unreeling the coiled tubing 104.

The coiled tubing 104 can then be withdrawn until the tools 110 contact the latching sub 10. The mechanism in the sub 10 is reengaged to attach to tools 110 to the sub 10, and the coiled tubing 104 can then be withdrawn from inside the pipe 106. The pipe 106 and the tools 110 can then be withdrawn from the wellbore 100 by removing sections 108 from the pipe 106.

The operation of the mechanism in the latching sub 10 and operation of the submersible connector can be better understood by referring to FIG. 2. The sub 10 comprises a short section of cylindrical tube which can be threadedly engaged to the pipe (shown as 106 in FIG. 1). The sub further comprises J-latch pins 26 disposed near the lower end of the sub 10. The pins 26 form a first part of the selectively operable latching mechanism which attaches the tools 110 to the pipe 106. A J-latch slotted collar 28 is attached to the top of the tools 110. The collar 28 forms a second part of the selectively operable latching mechanism. J-slots 30 forming part of the collar 28 engage the pins 26 to engage the first and second sections of the latching mechanism. The shape of the slots 30 can be seen in plan view by referring to FIG. 2A.

Referring again to FIG. 2, the latching sub 10 also comprises a stop collar 36, forming part of the inner wall of the sub 10. The collar 36 forms part of the operating mechanism of the submersible connector as will be further explained. After the pipe 106 is inserted into the wellbore 100 so that the tools 110 are positioned at the predetermined depth, the coiled tubing 104 is inserted through the interior of the pipe (shown as 106 in FIG. 1).

Referring now to FIG. 3, when the coiled tubing 106 is pushed onto the top of the tools 110, a female connector assembly 18 forming part of the connector component attached to the coiled tubing 104 engages a male connector assembly 20 forming part of the other component of the connector attached to the tools 110. Collet fingers 22 attached to the male end of the connector push back a spring loaded retainer sleeve 24 to enable upset ridges 22A in the upper end of the collet fingers 22 to engage a mating groove 23 in the female connector component. When the fingers 22 engage the groove 23, the coiled tubing 104 is mechanically engaged to the tools 110, and the tubing 104 can then move the tools 110.

The tubing is then pulled upward a few inches so that the pins 26 can move out of the initial position (shown as 30B in FIG. 3A) of the J-slots 30. The pipe 106 can be rotated approximately one-quarter turn to position the pins 26 in disengagement portions (shown as 30C in FIG. 3A) of the slots 30. The tubing 104 is then pushed downward until the slots 30 completely clear the pins 26.

Figure 4:
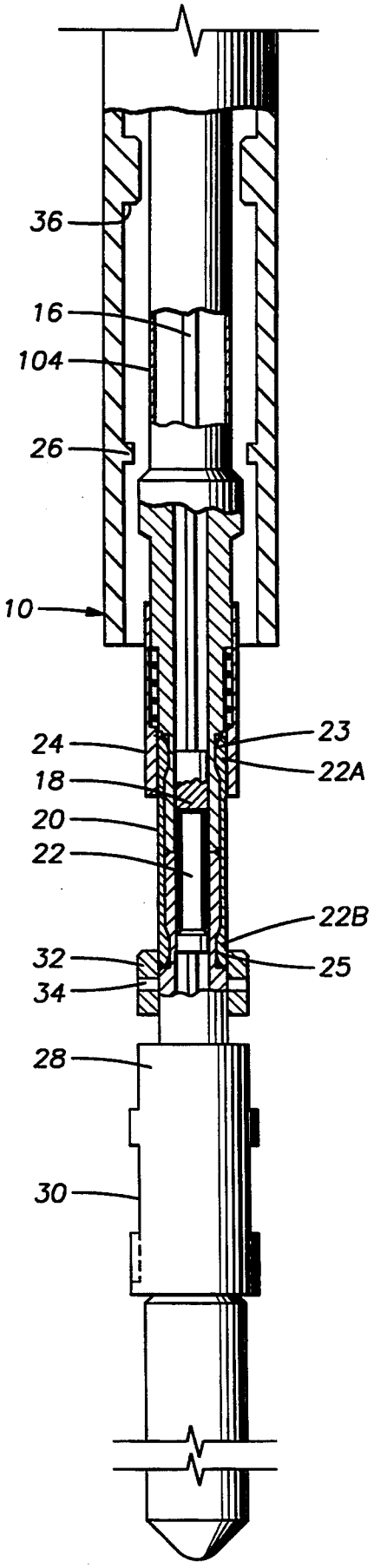
FIG. 4 shows the tools being further inserted into the wellbore after disengagement of the latching mechanism.

As shown in FIG. 4, after the slots 30 completely clear the pins 26, the tools 110 can be pushed out of the bottom of the sub 10 by further unreeling the coiled tubing 104. The tools 11 can then be further inserted into the wellbore 100 until a desired depth is reached. The tubing 104 can then be then slowly withdrawn from the wellbore 100 so that measurements of earth formations (not shown) can be transmitted to the surface unit (shown as 116 in FIG. 1). Alternatively, the tools 100 can be operated while stationary in the wellbore 100, as is done for example with perforating guns or formation fluid sampling devices.

Figure 5:
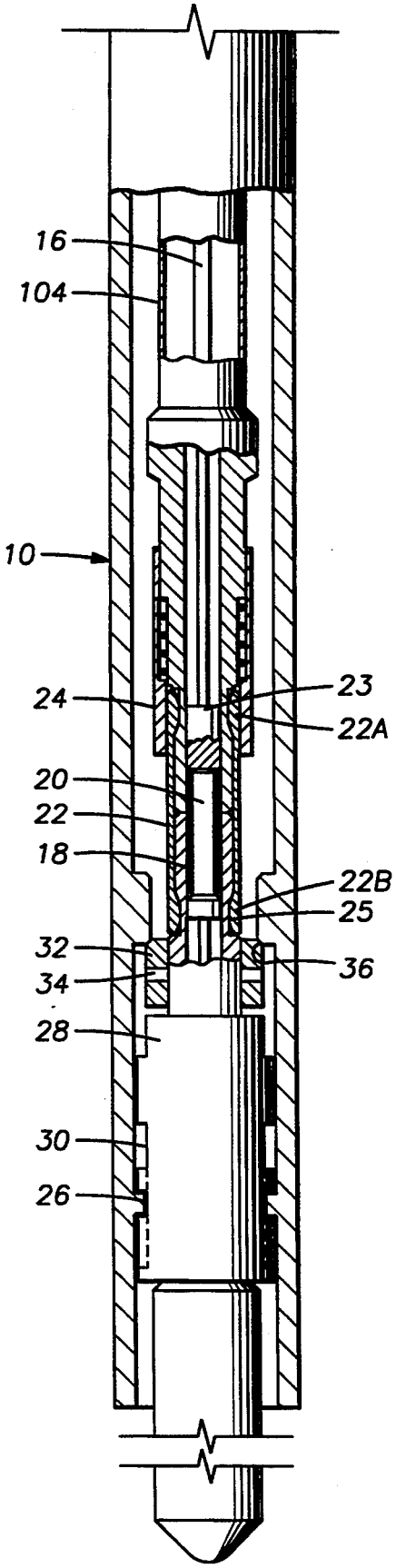
FIG. 5 shows the operation of the latching mechanism as the tools are reengaged with the latching sub, and the disengagement of the connector.
Figure 5A:
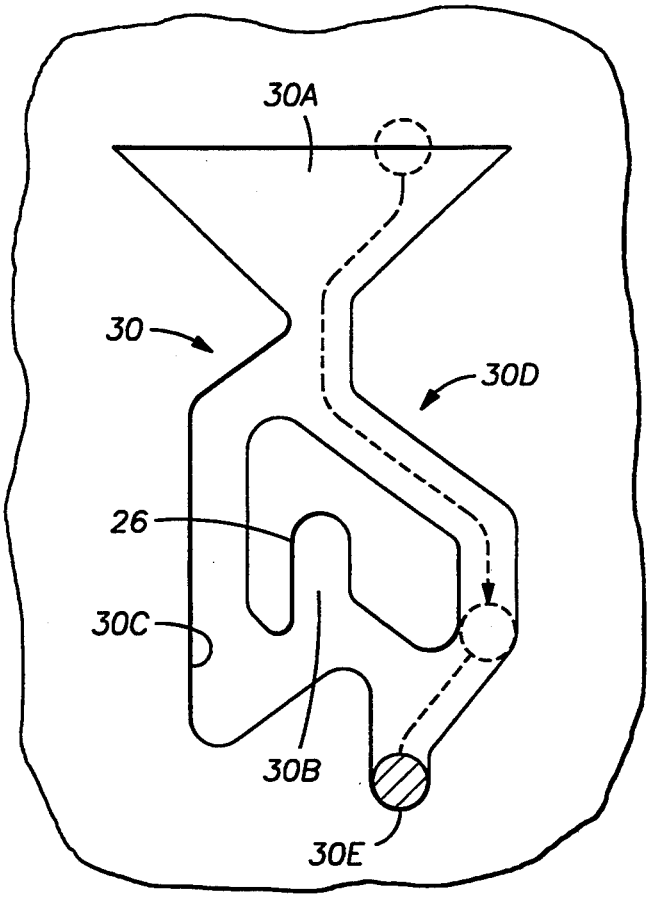
FIG. 5A shows the operation of the pins relative to the J-slots.

Referring now to FIG. 5, when the tools 110 have been withdrawn to the depth at which the sub 10 is positioned, the latching mechanism is reengaged by the pins 26 entering flared ends (shown as 30A in FIG. 5A) of the slots 30. As the tools 110 are withdrawn further, the pipe can be rotated about ninety degrees in the opposite direction to the previous rotation so that engagement portions (shown as 30D in FIG. 5A) of the slots 30 can contact the pins 26.

As the tools 110 are withdrawn further, a retainer ring 32, which forms part of the male component of the connector, comes into contact with the stop collar 36 in the sub 10. Continued upward pull on the tools eventually breaks shear pins 34 which lock the retainer ring 32 to the top of the tools 110. At this point the tools 110 can continue upward movement, which pulls the male end 20 of the connector upward relative to the retainer ring 32. The lower ends 22B of the collet fingers 22 are now free to disengage from a lower retaining groove 25, forming part of the other component of the connector, in which they were previously locked by the retainer ring 32.

The tools 110 can continue to move upward until the pins 26 engage lowermost positions (shown as 30E in FIG. 5A) in the J-slots 30. At this point the tools 110 are precluded from further upward motion relative to the pipe 106. The female end 18 of the connector can now be disengaged from the male end 20 by further withdrawal of the coiled tubing 104. The tubing 104 can then be completely withdrawn from the pipe 106.

Referring now to FIG. 6, as the connector is disengaged, the coiled tubing 104 no longer exerts upward pull on the tools 110. The tools 110 then drop back in the sub 10 so that the pins 26 are returned to the initial position (shown as 30B in FIG. 6A) in the J-slots 30. The tools 110 can then be withdrawn from the wellbore 100 by lifting the pipe 106, which typically is accomplished by disassembling sections (shown as 108 in FIG. 1) using the rig 114.

What is claimed is:

1. A method of inserting electric wireline tools into a wellbore penetrating an earth formation, said method comprising the steps of:

extending a pipe, having said tools coupled to the lower end of said pipe, to a predetermined position in said wellbore;

inserting a coiled tubing having a coaxially inserted wireline through said pipe;

mechanically coupling said coiled tubing to said tools and electrically coupling said tools to said wireline;

uncoupling said tools from said pipe; and extending said coiled tubing further into said wellbore with said tools attached to the lower end of said tubing.

2. The method as defined in claim 1 further comprising the step of operating said tools and simultaneously withdrawing said coiled tubing.

3. The method as defined in claim 2 further comprising the step of recoupling said tools to said pipe.

4. The method as defined in claim 3 further comprising the step of withdrawing said coiled tubing from the interior of said pipe.

5. The method as defined in claim 4 further comprising the step of withdrawing said pipe from said wellbore with said tools attached to said pipe.

6. The method as defined in claim 1 wherein said coiled tubing further comprises a first part of a submersible electrical connector attached to one end of said coiled tubing and said tools further comprise a second part of said connector attached to one end of said tools.

7. The method as defined in claim 1 wherein said pipe further comprises one part of a selectively operable latching mechanism attached to one end of said pipe and said tools further comprise a second part of said selectively operable latching mechanism attached to one end of said tools.

8. A method of inserting electric wireline tools into a wellbore penetrating an earth formation, said method comprising the steps of:

attaching a first part of a submersible electrical connector to one end of a coiled tubing;

electrically attaching said first part of said connector to said wireline;

attaching a latching sub to one end of a pipe, said latching sub comprising a first part of a selectively operable latching mechanism for releasably attaching said wireline tools to one end of said pipe;

attaching a second part of said submersible electrical connector to one end of said wireline tools;

attaching a second part of said selectively operable latching mechanism to said one end of said wireline tools;

attaching said second part of said selectively operable latching mechanism to said one part of said mechanism, thereby attaching said wireline tools to one end of said pipe;

inserting said tools to a predetermined depth within said wellbore by assembling sections to said pipe;

inserting said coiled tubing into the interior of said pipe until said one part of said submersible connector connects to said another part of said connector;

selectively operating said latching mechanism so that said second part of said mechanism is released from said first part of said mechanism;

inserting said coiled tubing further into said wellbore so that said wireline tools are inserted to a desired depth within the wellbore;

withdrawing said coiled tubing from said wellbore so that said tools engage said latching sub;

selectively operating said latching mechanism so that said first part of said mechanism latches to said second part of said mechanism, thereby attaching said tools to said pipe;

disengaging said submersible connector by withdrawing said coiled tubing;

withdrawing said coiled tubing from within the interior of said pipe; and withdrawing said tools from said wellbore by disassembling said sections from said pipe.

9. A method of inserting electric wireline tools into a wellbore penetrating an earth formation, said method comprising the steps of:

attaching a first part of a latching mechanism to one end of a pipe, said pipe defining an interior therein, said pipe assembled from sections;

attaching a second part of said mechanism to one end of said tools;

connecting said first part and said second part of said latching mechanism, thereby attaching said tools to said pipe;

inserting said tools into said wellbore by assembling said sections of said pipe;

inserting a coiled tubing into the interior of said pipe, said coiled tubing having a coaxially inserted wireline therethrough and having a first part of a submersible electrical connector disposed at one end;

connecting said first part of said connector to a second part of said connector disposed at the top of said tools;

operating said latching mechanism so as to release said tools from said pipe;

inserting said coiled tubing further into said wellbore so that said tools are positioned at a desired depth within said wellbore;

retracting said coiled tubing until said tools engage said pipe;

selectively operating said latching mechanism so as to attach said tools to said pipe;

disengaging said connector by retracting said coiled tubing;

withdrawing said coiled tubing from the interior of said pipe; and withdrawing said tools from said wellbore by disassembling said sections of said pipe.

10. An apparatus for inserting electric wireline tools into a wellbore penetrating an earth formation, said apparatus comprising:

a pipe assembled from sections, said pipe defining an interior;

a latching sub attached to one end of said pipe;

a coiled tubing having a coaxially inserted wireline, said coiled tubing having an external diameter enabling said coiled tubing to traverse said interior of said pipe;

a submersible electrical connector having a first part attached to one end of said coiled tubing and a second part attached to one end of said wireline tools, said connector making releasable electrical and mechanical connection between said coiled tubing and said wireline tools; and a selectively operable latch having a first component attached to said one end of said wireline tools and a second component affixed to said latching sub, said latching mechanism operable when said coiled tubing is inserted inside said pipe and connection of said first part to said second part of said submersible connector enables said coiled tubing to lift said tools while said pipe is turned, so that said selectively operable latching mechanism is disengaged to enable said coiled tubing to insert said tools further inside said wellbore.

* * * * *